US005336107A

United States Patent [19]

Sheryll

[11] Patent Number: 5,336,107

[45] Date of Patent: Aug. 9, 1994

[54] PLUG RETENTION DEVICE

[75] Inventor: Richard Sheryll, New York, N.Y.

[73] Assignee: Cyclops Research & Development, Inc., New York, N.Y.

[21] Appl. No.: 53,998

[22] Filed: Apr. 26, 1993

[51] Int. Cl.[5] ..... H01R 13/62

[52] U.S. Cl. ..... 439/369; 439/371

[58] Field of Search ..... 439/367, 369, 370, 371, 439/502, 894; 24/305, 573.1

[56] References Cited

U.S. PATENT DOCUMENTS

| | | | |
|---|---|---|---|
| 4,702,540 | 10/1987 | Siemon | 439/369 X |
| 4,907,984 | 3/1990 | Keller | 439/369 |
| 4,917,626 | 4/1990 | Barton | 439/369 |
| 4,957,450 | 9/1990 | Pioszak | 439/369 |
| 5,044,976 | 9/1991 | Thompson | 439/371 X |
| 5,167,524 | 12/1992 | Falcon et al. | 439/371 |

OTHER PUBLICATIONS

IBM Technical Bulletin, vol. 21 No. 2 Jul. 1978.

*Primary Examiner*—Khiem Ngyuen

*Attorney, Agent, or Firm*—Cobrin Gittes & Samuel

[57] ABSTRACT

A device for retaining an electrical plug and extension cord to another plug and extension cord employs fastener strip elements secured to the cord adjacent to the plug by a circumferential clamping element. When the electrical plug is engaged with a corresponding socket, the mechanical fastener elements secured to the plug engage cooperating fastening elements affixed to the corresponding socket to retain the assembly in its connected state. The fastener elements may be mushroom-type fastener elements such as those available under the name Dual Lock.

8 Claims, 2 Drawing Sheets

PLUG RETENTION DEVICE

BACKGROUND OF THE INVENTION

This invention relates generally to devices for connecting electrical cords for electrical tools and appliances, and more particularly, relates to apparatus and methods for maintaining secure connection of a first electrical cord and plug to another cord and plug.

In many industrial and commercial environments, it is often useful or necessary to connect a number of electrical extension cords, or to connect an extension cord to an electrical appliance. In these environments, if the plug and socket combination inadvertently disengage during use, such disconnection can cause inconvenience, down time, and even potential safety hazard.

Accordingly, various devices have been proposed and developed for retaining an electrical cord and plug to another cord and plug. Examples of such devices are set forth in the following U.S. Patents:

| Patent No. | Inventor |
|---|---|
| 3,475,716 | Laig |
| 3,613,046 | Kirk |
| 4,097,105 | Zumwalt |
| 4,440,465 | Elliott et al. |
| 4,690,476 | Morgenrath |
| 4,702,540 | Siemon |
| 4,917,626 | Barton |
| 4,957,450 | Pioszak |
| 5,026,300 | Varner |
| 5,044,976 | Thompson |
| 5,104,335 | Conley et al. |

By way of example, U.S. Pat. No. 4,690,476 to Morgenrath is directed to a device in which extension cords are secured together by first and second flexible strap elements, one having rings secured to its free ends, the other having mating hook and loop fastener elements attached to its free ends. When assembled, the second strap element is threaded through the rings on the first strap element and folded such that the hook and loop elements engage to secure the straps. U.S. Pat. No. 4,917,626 to Barton discloses a hook-and-loop securement system in which a strap having hook material is adhered to either side of a power tool plug such that the straps extend past the face of the plug for a selected distance. A pad of loop material is adhered to either side of the extension cord socket to engage the hook material when the plug and socket are engaged.

U.S. Pat. No. 4,957,450 to Pioszak is directed to a retainer assembly for releasably securing an electrical power plug and socket in a connected state to avoid inadvertent disconnection. The retainer includes a strap attached to the plug and socket, respectively, with securing elements for releasably attaching the opposite ends of the strap together to retain the plug and socket in the connected state.

U.S. Pat. No. 5,026,300 to Varner is directed to a plug-to-outlet retaining system utilizing cooperating hook and pile elements on the plug and the receptacle face.

U.S. Pat. No. 5,044,976 to Thompson discloses a plug-to-outlet retention system utilizing hook-and-loop fasteners, in which a cord-engaging element is fastened to a bracket affixed to the outlet.

Cord- and plug-securing devices typical of the prior art, however, suffer from a number of deficiencies. For example, conventional plug retention devices generally do not provide a high strength connection resistant to tensile forces. In particular, as the retention elements stretch under tensile loads, the plug and socket combination may inadvertently disengage during use, causing inconvenience and possibly a safety hazard.

Moreover, when employed in work sites and other areas in which dust and debris are prevalent, the hook and loop fastening strips utilized in certain conventional plug retention devices can become clogged with accumulated dust, thereby reducing effectiveness. In particular, as the individual hook and loop fastening elements fill with dust, the pull strength of the hook/loop connection decreases, such that the plug can pull away from the socket. Further, many conventional plug retention devices have little adjustability to various sizes of plugs and cords, so that they can not be utilized to accommodate larger high-amperage cords and plugs.

It is accordingly an object of the invention to provide improved plug retention methods and apparatus. Another object of the invention is to provide such apparatus that securely maintain engagement between plug and socket.

It is a further object to provide such apparatus that maintains a high strength connection between plug and socket in all types of environments. Yet another object of the invention is to provide such apparatus that can accommodate various sizes and configurations of electrical plugs, cords, and sockets.

Other general and specific objects of the invention will in part be obvious and will in part appear hereinafter.

SUMMARY OF THE INVENTION

The foregoing objects are attained by the invention, which provides a device for retaining an electrical plug and cord to another electrical cord and plug. In one aspect of the invention, the device employs fastener strip elements secured to the cord adjacent to the plug by a circumferential clamping element. When the electrical plug is engaged with a corresponding socket, the mechanical fastener elements secured to the plug engage cooperating fastening elements affixed to the corresponding socket to retain the assembly in its connected state- The fastener elements may be mushroom-type fastener elements; alternatively, they may include other types of interacting-article elements such as those depicted in U.S. Pat. No. 3,266,113, the teachings of which are incorporated herein by reference.

The invention will next be described in connection with certain illustrated embodiments. However, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and the accompanying drawings, in which.

DESCRIPTION OF ILLUSTRATED EMBODIMENTS

Figure 1A:
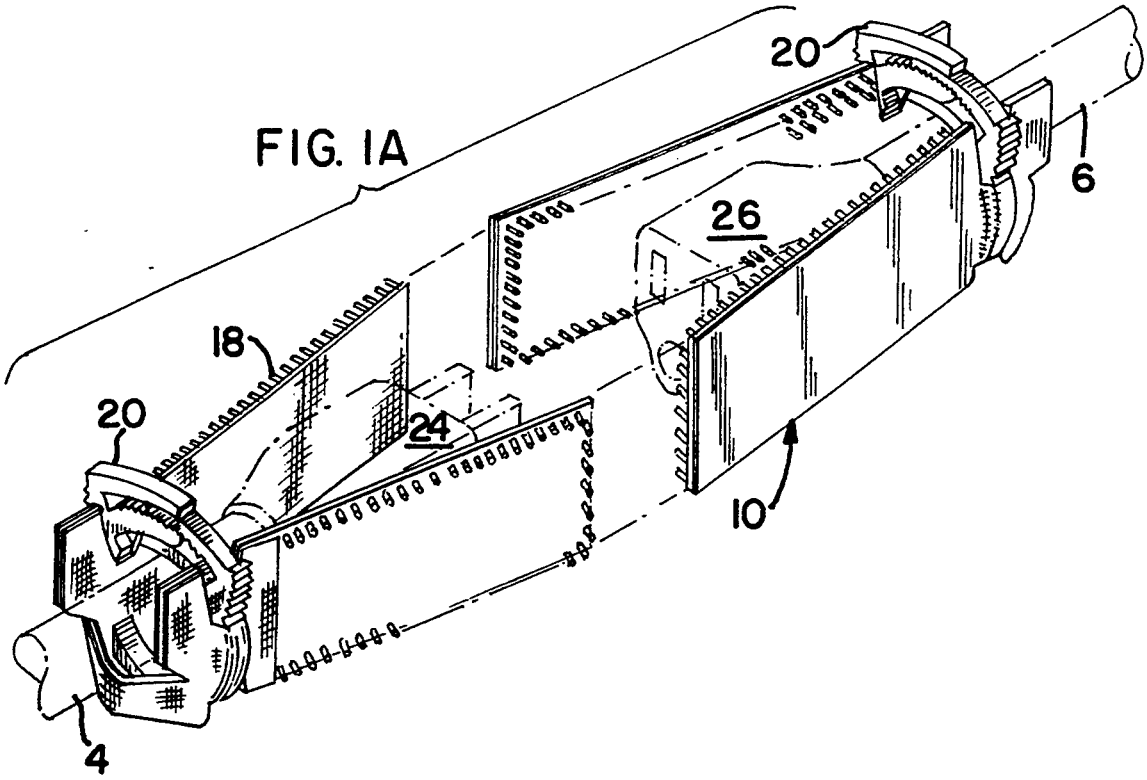
FIGS. 1A and 1B depict plug retention apparatus, in detached and attached states, respectively, constructed in accordance with the invention.
Figure 1B:
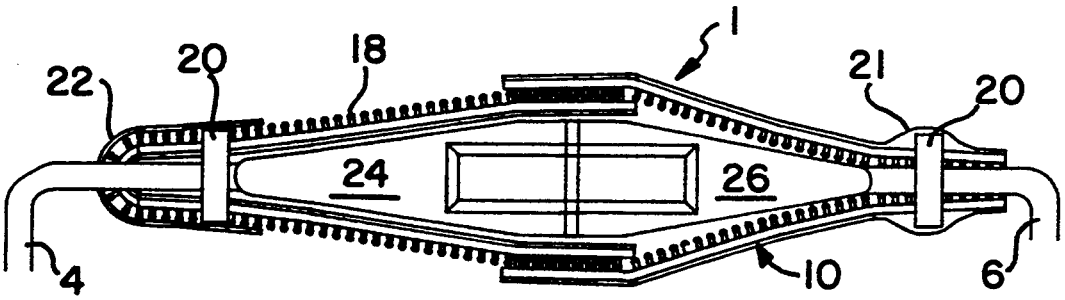

FIGS. 1A and 1B depict a plug retention apparatus constructed in accordance with the invention. In particular, FIGS. 1A and 1B depict views, in detached and attached states, respectively of a plug retention device 1 for securing and maintaining engagement of a first plug-type electrical connector 24 and corresponding cord 4, and a second socket-type connector 26 and corresponding cord 6. The device 1 includes first and second flexible fastening strap members 10 each having fastening elements 18 on an engagement surface.

First and second clamp elements 20 are coupled to the first and second straps 10, respectively, by retaining portions 21 and 22 as discussed below in connection with FIGS. 2A and 2B. The clamp elements retain the fastening elements in a folded configuration to their respective cords (FIGS. 1A and 1B). In particular, clamps 20 pass through clamp-carrying recesses 14, 16 and through loops defined by retaining or cover portions 21 (FIG. 2A) and 22 (FIG. 2B), respectively. When straps 10 are folded for engagement in the assembled state (FIG. 1B), the clamps 20 secure straps 10 to respectively cords 4, 6 and connectors 24, 26. Cords 4, 6 pass through cord-carrying recesses or slots 12 in respective straps 10. The straps have interacting fastening elements 18 that engage each other when in the assembled state (FIG. 1B) to maintain the connection of the electrical connectors 24, 26. As discussed in greater detail hereinafter, the fastening elements 18 may be of the mushroom-shaped type or other type of interacting-article elements such as those depicted in U.S. Pat. No. 3,266,113 (Flanagan, Jr.), the teachings of which are incorporated herein by reference.

While FIGS. 1A and 1B (and FIG. 4 as will be seen below) depict a circumferential clamp element, the invention may be practiced using other configurations of retaining elements including clip or clamp elements which may be molded integrally with the respective strap elements. The structures of the straps, fastening elements, and clamps are further addressed below in connection with FIGS. 2A, 2B, 3 and 4.

Referring again to FIGS. 1A and 1B, the retention of the engagement of connectors 24, 26 and respective cords 4, 6 is simply attained, by first opening the first and second clamp elements 20 and inserting or passing each electrical cord 4, 6 through the slot or recess 12 of the respective fastening straps 10 so that the cord rests in the recess or slot 12 of the respective fastening straps 10. The straps 10 are then folded around respective cords 4, 6 and the clamp elements 20 are then locked about the respective cords, preferably as closely as possible to the respective plug elements while allowing the clamps to be locked about the cords. This proximity minimizes slippage between the device and the respective cords. When used with plug/cord configurations having strain relief portions near the respective plugs, the clamp elements 20 can be locked about the strain relief portions.

The electrical connectors 24, 26 can then be pushed into an electrically and physically connected state, and the fastener elements 18 of the first and second fastening straps 10 are then engaged, thereby locking the two fastening straps together to maintain the engagement of electrical connectors 24, 26.

Figure 2A:
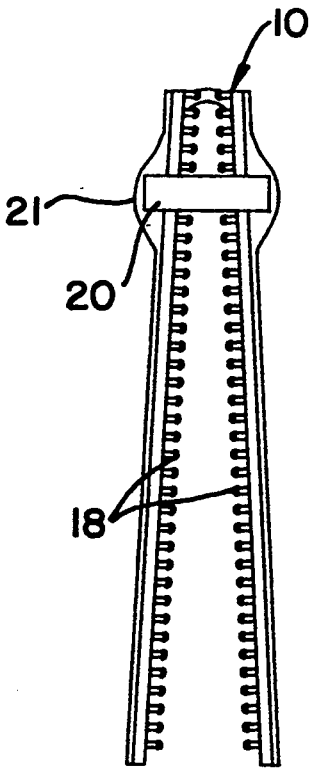
FIGS. 2A and 2B depict first and second flexible fastening members and clamp elements utilized in the plug retention apparatus according to the invention.
Figure 2B:
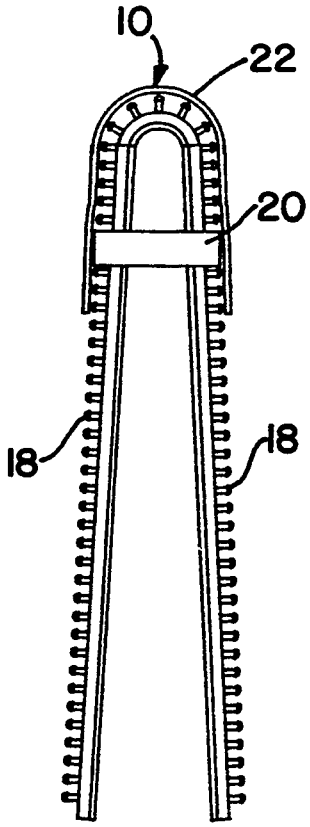

Details of the configuration of the straps 10 and clamps 20 are depicted in FIGS. 2A, 2B, 3 and 4. In particular, FIGS. 2A and 2B depict first and second flexible strap fastening members in the folded state for engagement therebetween, and ringforming clamp elements 20. FIG. 2A shows first flexible strap fastening member 10 having a set of integral stud-type or mushroom type fastener elements 18 on an interior surface of engagement. As noted above, the fastener elements 18 may be other types of interacting-article fastener elements such as those disclosed in U.S. Pat. No. 3,266,113 (Flanagan, Jr.), the teachings of which are incorporated herein by reference.

The strap member 10 and fastener elements 18 may be molded integrally from polyolefin or other suitable polymeric materials, and the strap 10 can be constructed with a backing component of woven nylon tape 21. As shown in FIG. 2A, the backing component of woven nylon tape 21 can form a retaining portion or loop that retains the circumferential clamp 20 to strap 10. The clamp 20 thus passes around the outside of strap 10 and is retained in place by the retaining portion of backing 21.

FIG. 2B depicts second flexible strap fastening member 10 in the folded state for engagement with first flexible strap fastening member 10. Second strap 10 includes fastener elements 18 arrayed about an exterior surface of engagement. As noted above, the fastener elements 18 may include other types of interacting-article fastener elements such as those disclosed in U.S. Pat. No. 3,266,113. FIGS. 1A, 1B, 2A, and 2B show that the interior and exterior fastening elements of the first and second straps, respectively, engage each other when in the assembled state (FIG. 1B), so as to fasten one strap to the other.

FIG. 2B also shows ring-forming circumferential clamp element 20, which passes around second strap 10 and through a loop formed by a cover element 22 that engages the exterior fastening surface of engagement of the second strap. The cover element 22 shown in FIG. 2B can be a strip of material, such as woven nylon tape, fastened to the strap 10 to form a retaining portion or loop through which clamp 20 passes. The cover element 22 may include fastening elements such as loops or interacting mushroom elements that engage with corresponding mushroom-shaped studs on fastener elements 18. Alternatively, the cover strip 22 may be fastened to the surface of strap 10 by adhesive, by sonic welding, by additional stud-type fastening elements, or by other conventional attaching techniques.

Figure 3:
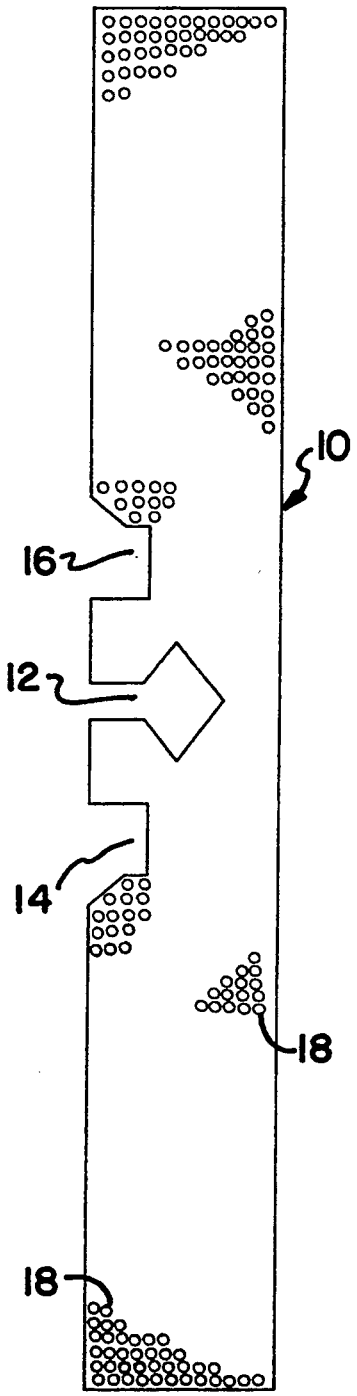
FIG. 3 depicts detail of a flexible fastening member utilized in the plug retention apparatus of FIGS. 1A and 1B.

FIG. 3 depicts detail of flexible fastening member utilized in the plug retention apparatus of FIGS. 1A and 1B. In particular, FIG. 3 shows the overall configuration of the fastening straps 10 having fastening elements 18. Each strap 10 includes a central slot or recess 12 for receiving a respective electrical cord (see FIGS. 1A, 1B, 2A, 2B) and outer recesses or slots 14 and 16 for receiving or accommodating retainer or clamp element 20 (see FIGS. 1A, 1B, 2A, 2B). These slots or recesses also provide clearance around the clamps and/or the cords during opening and closing of the first and second flexible strap elements 10. The structure of the two strap members is complementary, with both straps having fastening elements 18 on a surface of engagement, one having an inner surface of engagement as defined with reference to the folded state (FIG. 2A), and the other having an outer surface of engagement as defined with reference to the folded state (FIG. 2B). The retaining strip or cover strip 21, 22 (FIGS. 2A, 2B, respectively) for securing clamps 20 to strap members 10 is not shown in FIG. 3.

In one practice of the invention, the flexible member 10 and its fastening elements 18 may be constructed at least in part from polyolefin, with a woven nylon backing material 21. The fastening elements 18 can be constructed from polyolefin or other suitable materials in accordance with known practice for fabricating stud-type or mushroom-type fastening elements. Those skilled in the art will appreciate that a range of suitable materials can be utilized for the stud elements 18 and for the backing component 21.

Figure 4:
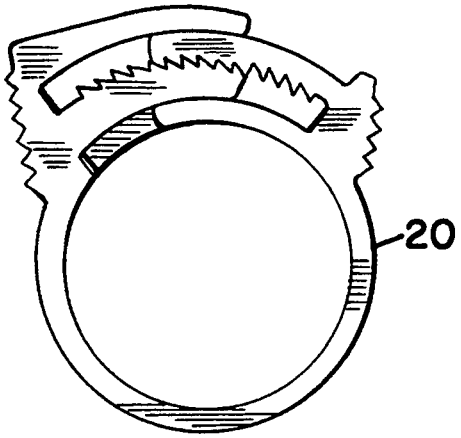
FIG. 4 depicts one configuration of a retaining element that may be utilized in the plug retention apparatus of FIGS. 1A and 1B.

FIG. 4 depicts detail of a ring-forming clamp element 20 utilized in the plug retention apparatus of FIGS. 1A and 1B. Such clamp may be a conventional hose or wire clamp element of the type utilized, for example, in automotive applications. In accordance with known clamp construction, the clamp depicted in FIG. 4 includes right and left portions each having teeth that engage and lock in place. The clamp may be unlocked by laterally pushing the engaging sides of the clamp out of engagement.

While the drawing figures depict a circumferential clamp element, those skilled in the art will appreciate that the invention may be practiced using other configurations of retaining elements including clip or clamp elements which can be molded integrally with the strap elements.

As noted above in connection with FIGS. 1A and 1B, the fastening elements 18 carried on the engaging surfaces of straps 10 may be of the stud-shaped or mushroom-shaped type. The mushroom-type fasteners may be of the type sold under the trademark DUAL LOCK by Minnesota Mining and Manufacturing Company ("3M"). Mushroom-type fasteners can be designed with studs having both male and female characteristics when intermeshed. Such a mushroom-type mechanical fastener is shown in U.S. Pat. No. 3,192,589 to Pearson, the teachings of which are incorporated herein by reference.

Another such fastener is shown in U.S. Pat. No. 3,266,113 to Flanagan, Jr. which is assigned to 3M. The Flanagan patent discloses mechanical fasteners using complementary pairs of inter-engaging unitary articles each having a function surface comprising a two-dimensional array of ordered and spaced apart spine-like elastic locking elements, the locking elements being spine-like stems terminating in enlarged shaped heads that bear against the heads of the complementary article during engagement.

U.S. Pat. No. 3,718,725 to Hamano teaches that the hook strip of a hook-and-loop fastener can be made from a fabric having an orderly array of upstanding loops. Each loop can be melted and compressed at its terminus to form a knob or head. Because the knobs or heads afford a mushroom appearance, this type of fastener is called "mushroom type."

In certain applications, fastening elements of the mushroom or stud configuration have advantages over hook and loop fastener elements. In particular, mushroom-shaped fasteners such as those sold under the name Dual Lock are less susceptible to clogging by dirt, dust or debris, such as sawdust, and thus will maintain a high pull strength. In an embodiment of the invention utilizing fastening elements of the Dual Lock type, the entire plug retaining apparatus may be molded from plastic, thereby reducing complexity and cost. By way of example, the clamp or retaining elements 20 could be molded integrally with the strap elements 10, thereby eliminating separate parts and associated assembly costs. Additionally, in certain regions of the fastening elements, some of the studs or pegs may be removed after molding, or simply not molded in, if not required. Pull tabs could also be molded into or otherwise incorporated into the straps, such as by removing fastening elements in selected areas. The use of pull tabs would facilitate separation of the straps to permit detachment of the electrical plug and socket after use.

It will thus be seen that the invention efficiently attains the objects set forth above, among those made apparent from the preceding description. In particular, the invention provides an improved plug retention device that is convenient to use, and effectively holds a plug to a socket in a variety of environments. It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A retaining device for releasably securing together first and second mutually engaging connectors extending from respective first and second cords each having a lengthwise axis, the retaining device comprising first and second elongate members having substantially the same overall shape and each having a lengthwise axis, for engaging the first and second cords, and adapted for folding about and surrounding the first and second mutually engaging connectors, respectively, with the lengthwise axis of said first and second elongate members substantially parallel to the lengthwise axis of said first and second cords, securement elements carried on said first and second elongate members, for releasably Joining together ends of said first and second elongate members when said first and second elongate members are folded about and surround the first and second mutually engaging connectors, wherein said members have at least one slot formed therein for receiving the cord, whereby the members surround the connectors to prevent separation thereof, first and second retaining elements, coupled to said first and second elongate members and situated adjacent the first and second connectors, respectively, for retaining the first and second cords to the first and second elongate members, respectively, said first and second retaining elements being clamps adapted for selectively locking about respective ones of said cords, andmaintaining a selected clamping force around respective ones of said cords when said members are folded about said connectors, wherein said securement elements are cooperatively interacting and inter-engaging pairs of substantially identical elements arrayed over substantially the entire surface of said first and second elongate members.

2. A device according to claim 1, wherein said first member comprises a first central cord-receiving slot formed in a central portion of said first member for receiving the first cord therein.

3. A device according to claim 2, wherein said second member comprises a second central cord-receiving slot formed in a central portion of said second member for receiving the second cord therein.

4. A device according to claim 2, wherein said first member comprises a first retaining element-accommodating slot, formed in said first member proximate to said first central cord-receiving slot, for accommodating said first retaining element and for providing a selected clearance during opening and closing and when said clamp is locked about respective ones of said cords.

5. A device according to claim 3, wherein said second member comprises a second retaining element-accommodating slot, formed in said second member proximate to said second central cord-receiving slot, for accommodating said second retaining element and for providing a selected clearance during opening and closing and when said clamp is locked about respective ones of said cords.

6. A device according to claim 1 wherein said first and second members are formed from nylon or polyolefin with said cooperatively interacting and inter-engaging pairs of elements formed integrally therewith.

7. A device according to claim 5 wherein said second member further comprises a cover element, at least one end of said cover element being affixed to said second member proximate said second retaining element-accommodating slot, for covering said clamp when said clamp is received in said second retaining element-accommodating slot.

8. A device according to claim 1, wherein a first set of said cooperatively interacting and inter-engaging pairs of elements are arrayed about at least an end portion of a surface of said first elongate member that defines an interior surface when said first elongate member is folded about the first connector, and a second set of said cooperatively interacting and inter-engaging pairs of elements are arrayed about at least an end portion of a surface of said second elongate member that defines an exterior surface when said second elongate member is folded about the second connector, so that said first set and said second set of said cooperatively interacting and inter-engaging pairs of elements can be placed in contact when said first and second elongate members are folded about the connectors, thereby to cooperatively and releasably join together the ends of said first and second elongate members.

* * * * *